US007318688B1

(12) United States Patent
Bavaro et al.

(10) Patent No.: US 7,318,688 B1
(45) Date of Patent: Jan. 15, 2008

(54) SCREEDING APPARATUS

(76) Inventors: Vito A. Bavaro, 26319 Magnolia Ave., Escalon, CA (US) 95320; Lance William Bavaro, 18400 S. Brennan Rd., Escalon, CA (US) 95320

( * ) Notice: Subject to any disclaimer, the term of this patent is extended or adjusted under 35 U.S.C. 154(b) by 0 days.

(21) Appl. No.: 11/880,296

(22) Filed: Jul. 20, 2007

Related U.S. Application Data

(63) Continuation-in-part of application No. 11/397,229, filed on Apr. 3, 2006, now abandoned.

(51) Int. Cl.
*E01C 19/22* (2006.01)

(52) U.S. Cl. ..... 404/119; 404/118

(58) Field of Classification Search ..... 404/100, 404/101, 102, 103, 105, 106, 114, 115, 118, 404/119
See application file for complete search history.

(56) References Cited

U.S. PATENT DOCUMENTS

| | | | |
|---|---|---|---|
| 3,593,627 | A | 7/1971 | Rowe et al. |
| 4,132,492 | A | 1/1979 | Jenkins |
| 4,314,773 | A | 2/1982 | Allen |
| 4,340,351 | A | 7/1982 | Owens |
| 4,466,757 | A | 8/1984 | Allen |
| 4,577,994 | A | 3/1986 | Miller |
| 4,685,826 | A | 8/1987 | Allen |
| 4,758,114 | A | 7/1988 | Artzberger |
| 6,685,390 | B1 | 2/2004 | Eitzen |

*Primary Examiner*—Raymond W Addie
(74) *Attorney, Agent, or Firm*—Thomas R. Lampe

(57) ABSTRACT

Screeding apparatus includes an elongated support and a strike board extending from a carriage on the elongated support, the support moved by drive structure along spaced side forms. The carriage and strike board are moved relative to the elongated support to engage, move and compact wet concrete within a cavity between said side forms during formation of a concrete slab.

10 Claims, 6 Drawing Sheets

SCREEDING APPARATUS

This application is a continuation-in-part of U.S. patent application Ser. No. 11/397,229, filed Apr. 3, 2006 now abandoned.

TECHNICAL FIELD

This invention relates to a screeding apparatus for engaging, moving and compacting wet concrete during formation of a concrete slab.

BACKGROUND OF THE INVENTION

Screeding of concrete to form slabs is a well known process. For small slabs, screeding is often accomplished by manual tools. Screeding machines exist for screeding larger slabs. The standard approach when using screeding machines is to have one or more workers employ shovels to perform the back breaking work of pregrading poured concrete for the screed. This approach is relatively expensive and inefficient.

The following United States patents are believed to illustrate screeding equipment representative of the current state of the prior art in this field: U.S. Pat. No. 3,593,627, U.S. Pat. No. 4,132,492, U.S. Pat. No. 4,314,773, U.S. Pat. No. 4,340,351, U.S. Pat. No. 4,466,757, U.S. Pat. No. 4,577,994, U.S. Pat. No. 4,685,826, U.S. Pat. No. 4,758,114, and U.S. Pat. No. 6,685,390.

The known prior art does not teach or suggest the screeding apparatus disclosed and claimed herein.

DISCLOSURE OF INVENTION

With the apparatus of the present invention, screeding of a concrete slab can readily and efficiently be accomplished without employing personnel utilizing shovels to do the back breaking work of pregrading poured concrete for the screed. In fact, the apparatus of this invention lends itself to operation by a single individual. Slabs are completed in an expeditious manner and the screeding machine has relatively low construction and maintenance costs as compared to other screeding apparatus employed when forming a screeding large slabs.

The screeding apparatus is for engaging, moving and compacting wet concrete during formation of a concrete slab in a space defined by spaced side forms.

The apparatus includes a double-ended, elongated support extending across the space and between the spaced side forms.

Support transport structure is incorporated in the screeding apparatus for transporting the elongated support in a predetermined direction along the spaced side forms. A carriage is mounted on the elongated support for movement along the elongated support in a direction transverse to the predetermined direction.

A strike board depends from the carriage for engaging wet concrete in the space.

Carriage mover structure is employed for moving the carriage and the strike board transverse to the predetermined direction along the elongated support to selectively position the carriage and the strike board in selected alternative positions over the space whereby the strike board is engageable with wet concrete of different width segments of the concrete slab between the spaced side forms.

The strike board is associated with structure which moves the strike board up or down relative to the carriage and vibrator structure for vibrating the strike board.

The strike board vibrates, compacts and strikes poured concrete to a desired height within the space and moves excess concrete to the front or rear of the pour without employing workers using shovels to pregrade concrete for the screed.

Other features, advantages and objects of the present invention will become apparent with reference to the following description and accompanying drawings.

MODES FOR CARRYING OUT THE INVENTION

Figure 1:
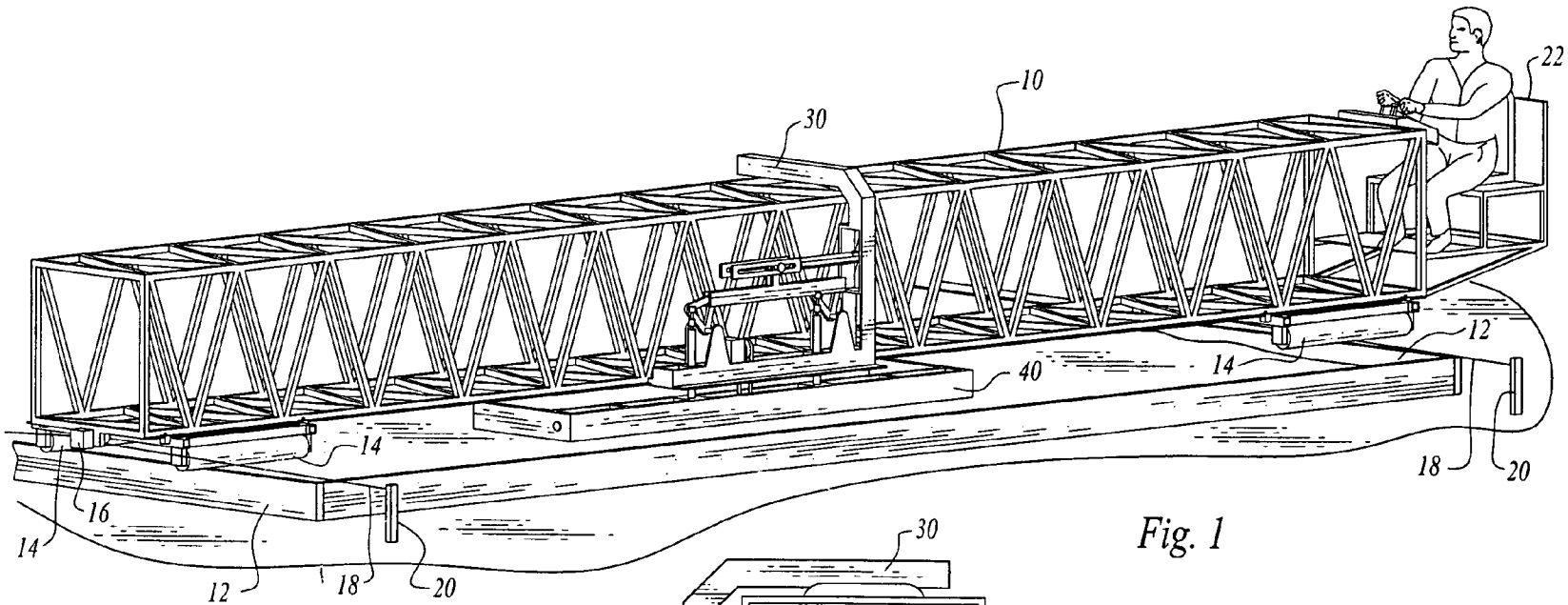
FIG. 1 is a perspective view of apparatus constructed in accordance with the teachings of the present invention in operation to form and screed a slab between spaced side forms.
Figure 2:
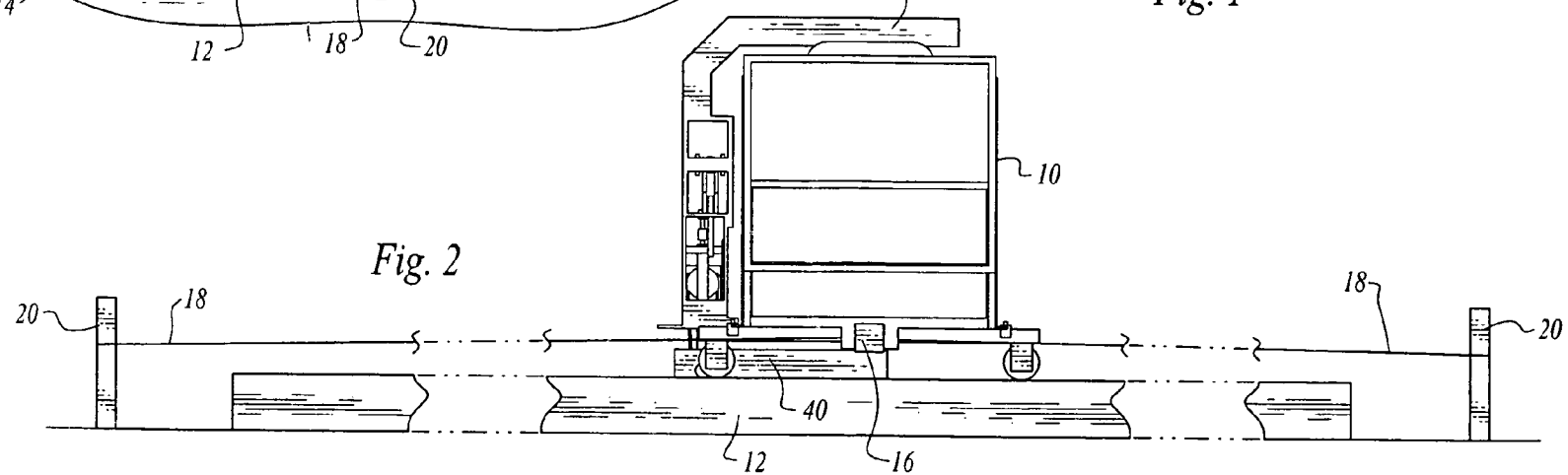
FIG. 2 is an elevational view of an end of the apparatus.
Figure 3:
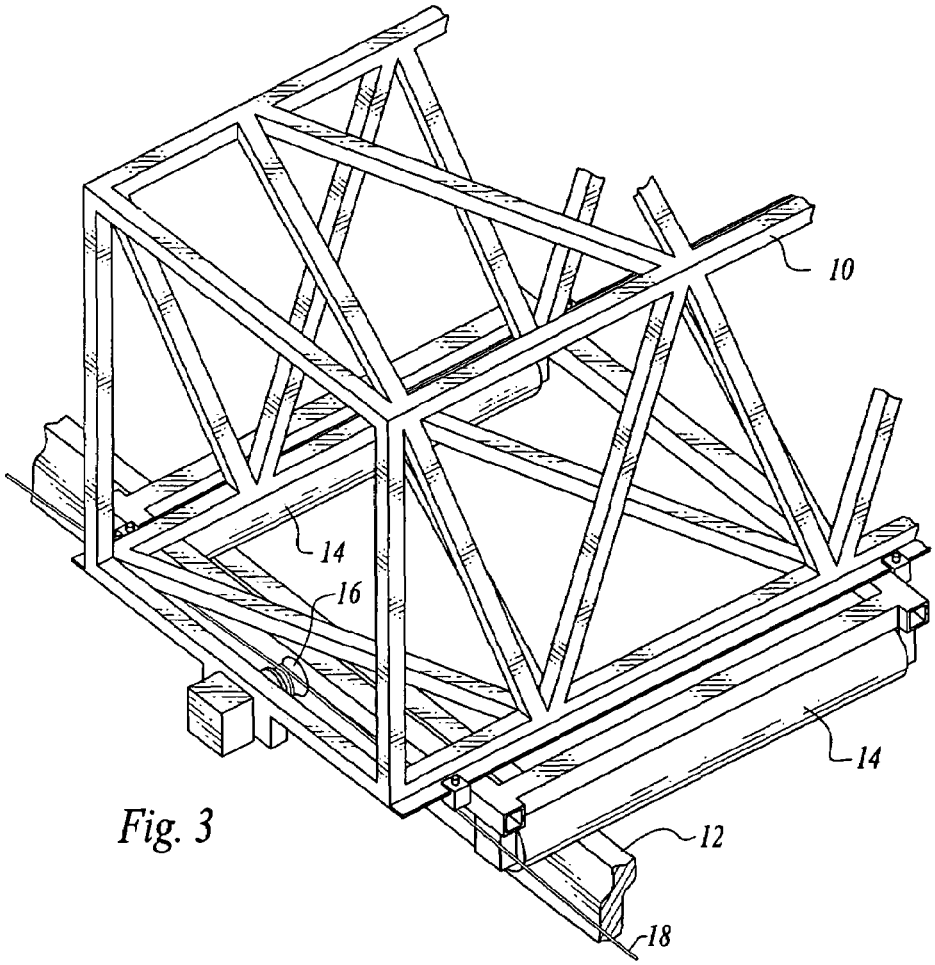
FIG. 3 is an enlarged, perspective view illustrating an end of the support of the apparatus and showing operational details of the support transport structure for moving the support.
Figure 5:
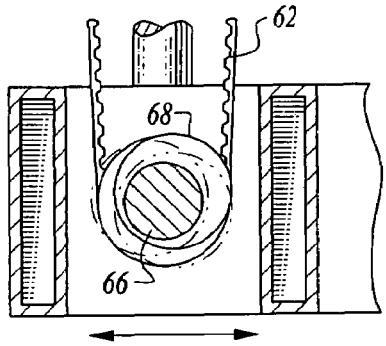
FIG. 5 is a cross-sectional view taken along line 5-5 of FIG. 4.
Figure 4:
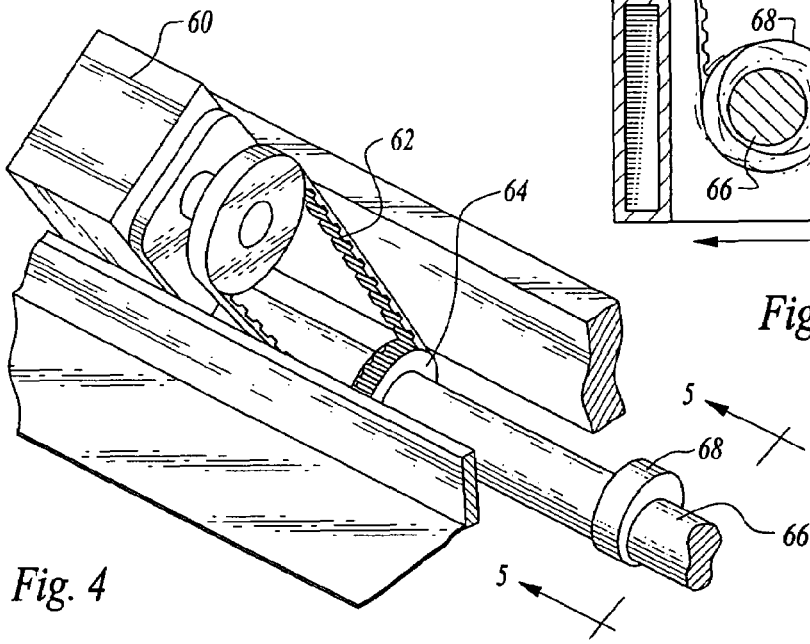
FIG. 4 is a greatly enlarged, perspective view illustrating selected components of vibrator structure for vibrating the apparatus strike board.
Figures 6, 6A:
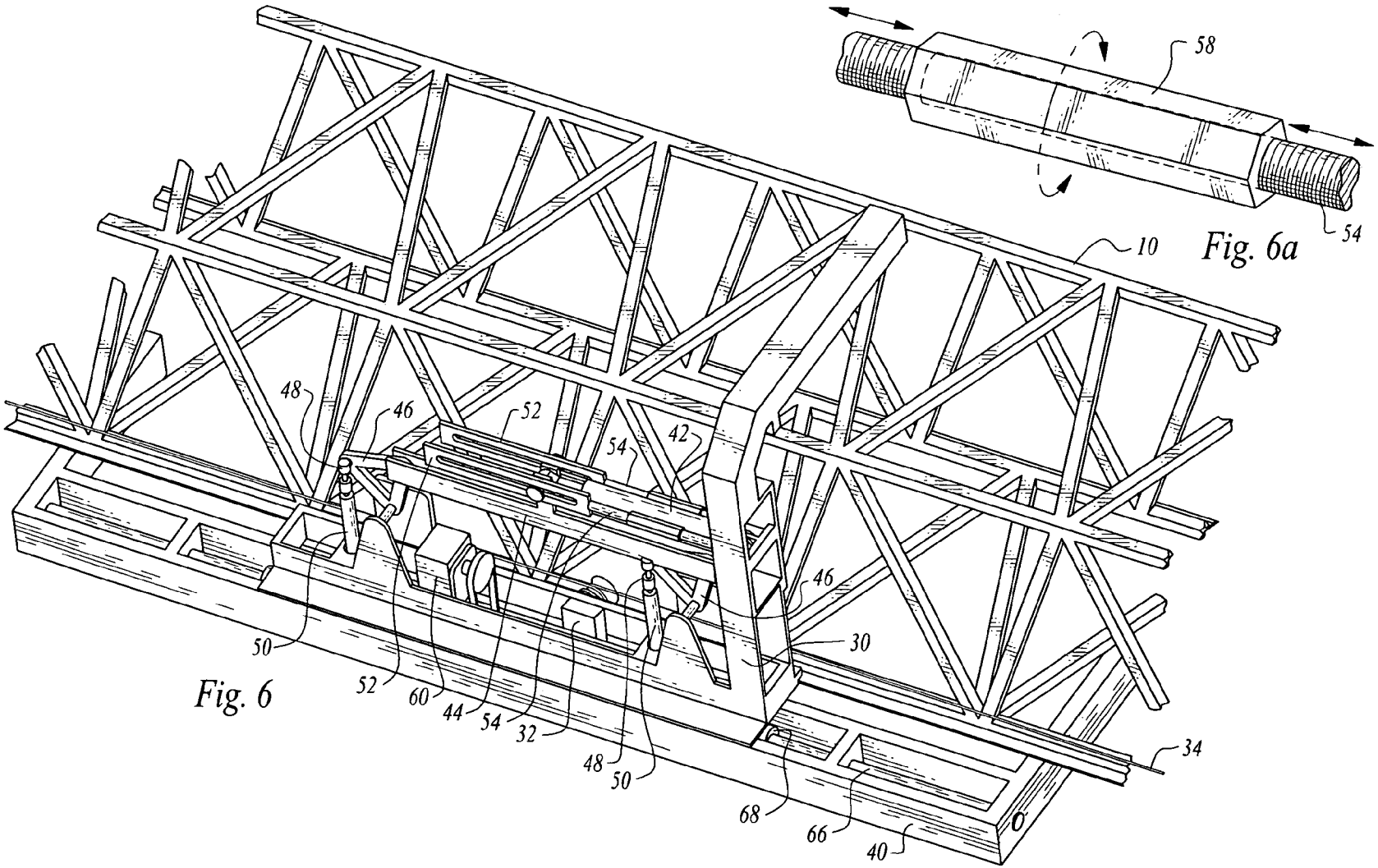
FIG. 6 is a top, perspective view of selected structure of the apparatus, including a carriage and mechanism employed to impart up and down movement and to vibrate the illustrated strike board.
FIG. 6A is an enlarged, perspective view of a turnbuckle employed to limit downwardly movement of the strike board.

Referring now to FIGS. 1-8 of the drawings, a first embodiment of apparatus constructed in accordance with the teachings of the present invention includes a double-ended, elongated support in the form of an open framework or truss 10. The framework extends across and above a cavity defined by spaced side forms 12. Rollers 14 mounted at opposed ends of the elongated support are positioned on the spaced side forms.

The rollers 14 comprise components of support transport structure for transporting the framework 10 in a predetermined direction (corresponding to the direction of the side forms) along the spaced side forms. Hydraulic capstan winches 16 are located at the ends of the framework 10. Cables 18 extend along the lengths of the side forms, the ends thereof being held in place by stakes 20 or in some other manner. The cables 18 are wrapped about the rotating drums of the hydraulic capstan winches. Rotation of the winches will serve to move the framework either forward or rearward along the side forms. This operation is controlled by an operator at a station including a seat 22 located at one end of the framework through suitable controls.

A carriage 30 is mounted on the framework for movement along the framework in a direction transverse to the direction of travel of the framework. Bearings (not shown) are preferably employed between the carriage and the framework to facilitate such movement.

Carriage mover structure is provided for moving the carriage along the framework. In the arrangement illustrated, this is accomplished through use of a third hydraulic capstan winch 32 (FIG. 6) operated independently from winches 16 by the operator. A cable 34 extends the length of the framework and is attached at the framework ends. Cable 34 is wrapped about the rotating drum of the hydraulic capstan winch 32 so that the carriage can be moved to any desired location along the framework.

A strike board 40 depends from carriage 30, the strike board 40 in the illustrated embodiment of the invention being in the form of a rectangular-shaped frame.

Figure 7:
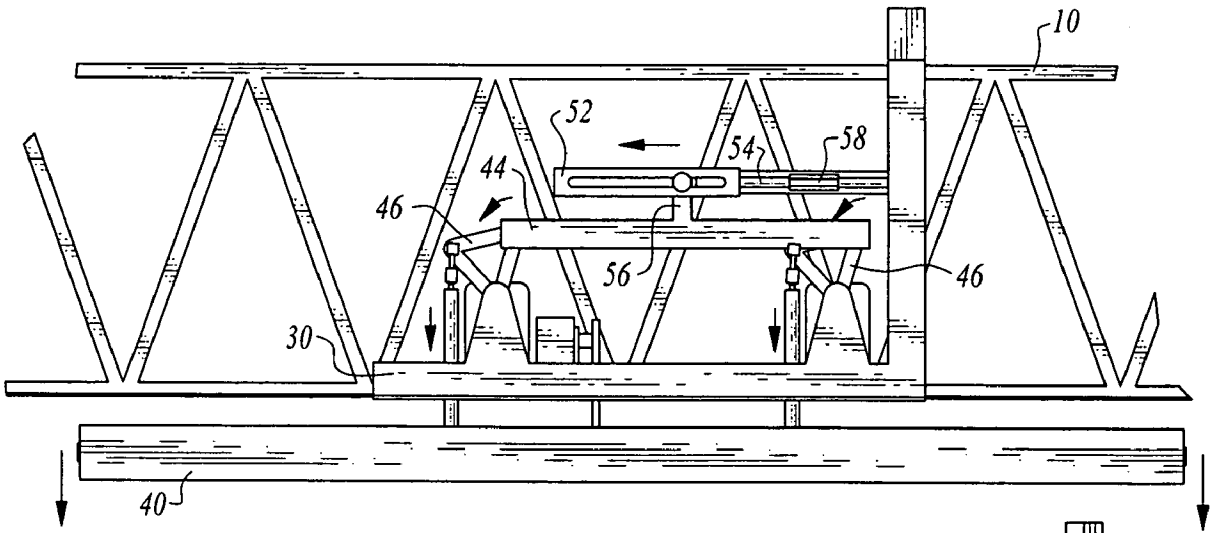
FIGS. 7 and 8 are elevational views of the carriage on a portion of the support showing components of the strike board moving structure in alternative positions when the strike board is raised and lowered, respectively.

Strike board moving structure is operatively associated with the carriage and the strike board for selectively moving the strike board up or down relative to the carriage. FIG. 7 illustrates the strike board in its elevated or up position and FIG. 8 shows the strike board 40 in its lowered or down position.

Mechanical linkage and a prime mover in the form of a hydraulic cylinder 42 (FIG. 6) is employed to raise and lower the strike board. The movable piston arm of the hydraulic cylinder 42 is connected to a T-shaped cross-member 44 of the mechanical linkage. Pivotally connected at the ends of cross-member 44 are link members 46, the link members 46 also being pivotally connected to carriage 30 at the lower ends thereof.

Figure 8:
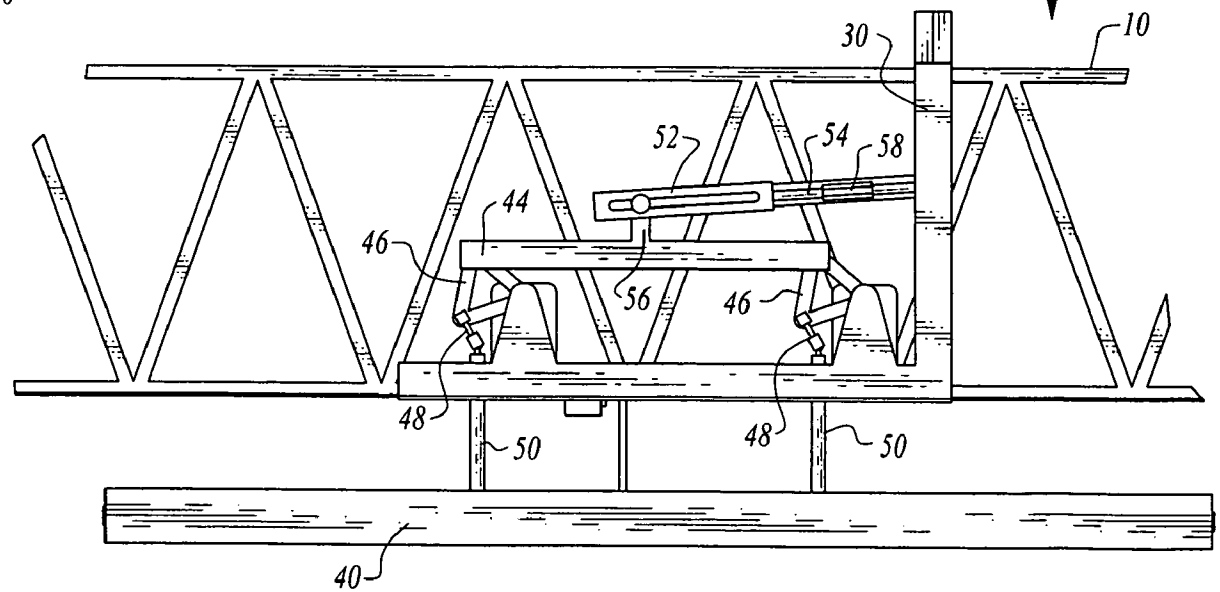
Figure 9:
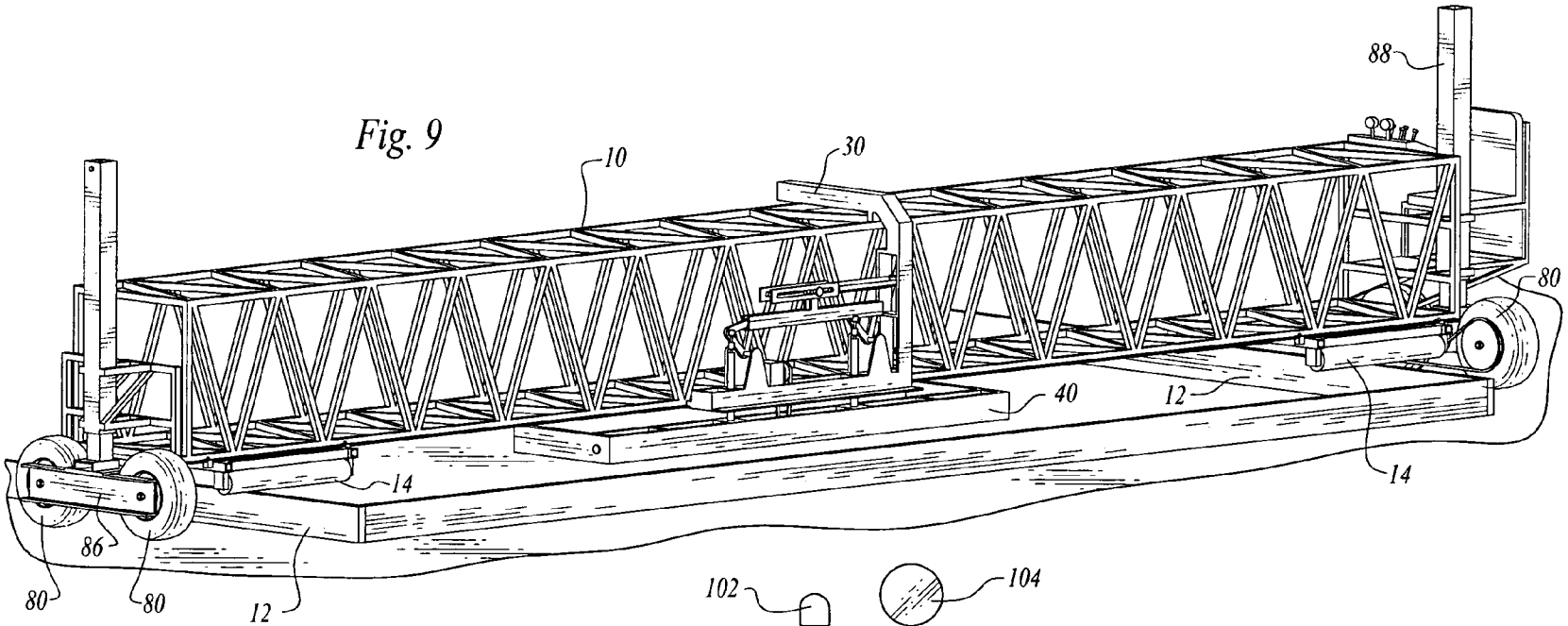
FIG. 9 is a perspective view of an alternative embodiment of the invention incorporating hydraulically operated jacks.

Extension of the hydraulic cylinder 42 by the operator at station or seat 22 will cause the cross-member 44 to move from the position of FIG. 7 to the position of FIG. 8 and consequent rotation of link members 46 to their illustrated positions in FIG. 8. Movement of links 48, 50 of the mechanical linkage results in the desired movement of the strike board. Retraction of the hydraulic cylinder by the operator will cause the strike board to move upwardly. Slotted guides 52 provide support and stability for the cross-member 44.

In addition, the slotted guides are employed to positively control how deep the strike board enters into the space or cavity defined by spaced side forms 12. The guides are adjustably connected at their proximal ends to threaded rods 54 pivotally connected at the other ends thereof to carriage 30. Each rod has two sections connected by a turnbuckle nut 58 threadedly positioning the two sections to change the total effective lengths of the combined slotted guides and rods. When the outer ends of the vertical portion 56 of the T-shaped cross-member engage the guides 52 at the outer ends of the slots thereof, further downward movement of the strike board is prevented.

Vibrator structure is operatively connected to the strike board 40 to vibrate the strike board. The vibrator structure includes a hydraulic drive motor 60 mounted on the carriage 30 and operated by the operator. A drive belt 62 (FIGS. 4 and 5) is driven by drive motor 60, the other end of the drive belt being looped about a gear 64. Operation of the drive motor 60 will cause rotation of the gear 64 and the shaft 66 to which it is attached. The shaft 66 extends the length of the strike board and is rotatably journaled with respect thereto. One or more weights 68 are eccentrically and fixedly mounted on the shaft 66. When the drive motor rotates shaft 66 and the eccentrically attached weight or weights, the strike board will vibrate. Control of the drive motor is accomplished by the operator at station 22.

With the arrangement described above, the single operator employs the drive winches, the up and down strike board function and vibrator function to compact and scrape excess concrete in the cavity between the side forms in low areas in the slab being poured. The operator would not normally process the full width of the slab, but instead process width segments of the slab, moving the carriage and strike board to selected alternative positions over the space whereby the strike board is engageable with wet concrete of different width segments of the concrete slab between the spaced side forms. This structure and operation compact and scrape excess concrete to low areas in the slab being poured. The operator can move the apparatus at will either forward and backward along the side forms to work the concrete in the cavity defined by the side forms in any manner desired to accomplish his objectives.

For example, the truss of the apparatus may be up to 80 feet or more in length, depending upon the width of the slab. The strike board may be 12 feet long for example, and the operator will utilize the apparatus to consecutively process different width segments as determined by the size of the pour, moving the carriage down the truss to process another 12 feet along the length of the pour until the partial slab width is complete. Then the apparatus will be moved down the slab length and the process started again.

Another advantage resides in the ability of the operator to move the carriage along the truss to avoid engaging structural elements, for example posts, pipes, etc., in the space between the side forms with the strike board as the truss moves along the side forms.

FIGS. 9-13 describe an alternate embodiment of the apparatus which is similar in many respects to the embodiment of FIGS. 1-8 described above. Like structural components are designated by like reference numerals.

This alternate embodiment incorporates a different form of drive system. Rather than utilizing a capstan/cable drive, this embodiment supports the framework 10 not only on rollers 14 but also on two pairs of ground engaging ground wheels 80, one pair disposed at each end of the framework. The wheels of each pair of wheels are driven by a belt 82 which in turn is driven by a hydraulic motor 84 (see FIG. 11).

Each pair of wheels and associated drive motor are supported on a rigid T-shaped structural element 81 which is affixed to the movable piston arm of hydraulic jack 88 (FIG. 11) disposed in a vertical housing attached to the framework.

The hydraulic jacks are employed to selectively move the framework 10 toward or away from the drive wheels 80 to vary the weight carried by the drive wheels and the rollers. The objective of this arrangement is to cause the wheels to carry the great majority of the weight of the framework, carriage and other structure, such as the strike board, associated therewith. A relatively small percentage of the weight is borne by the rollers 14. Extra heavy duty side forms don't have to be used and the tires of the wheels are kept in contact with the ground at a specific amount of pressure for traction.

Figure 10:
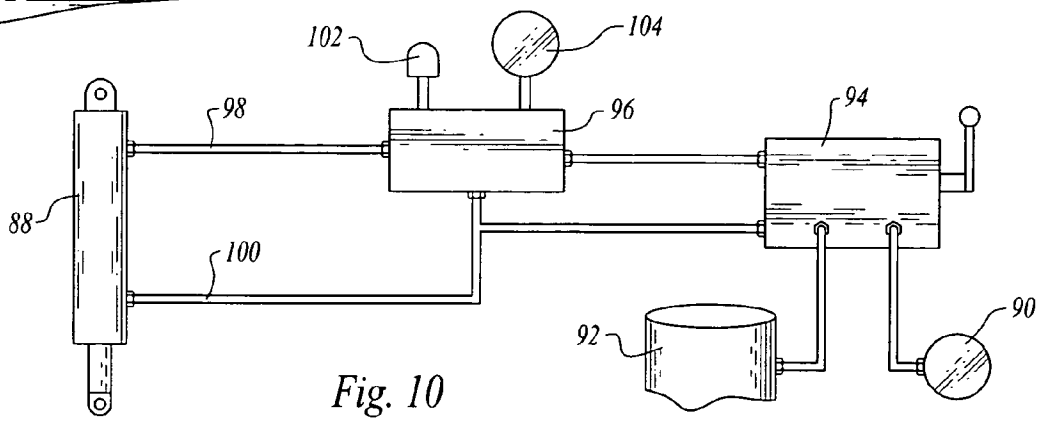
FIG. 10 is a schematic illustration of hydraulic control structure operatively associated with a hydraulic jack.
Figure 11:
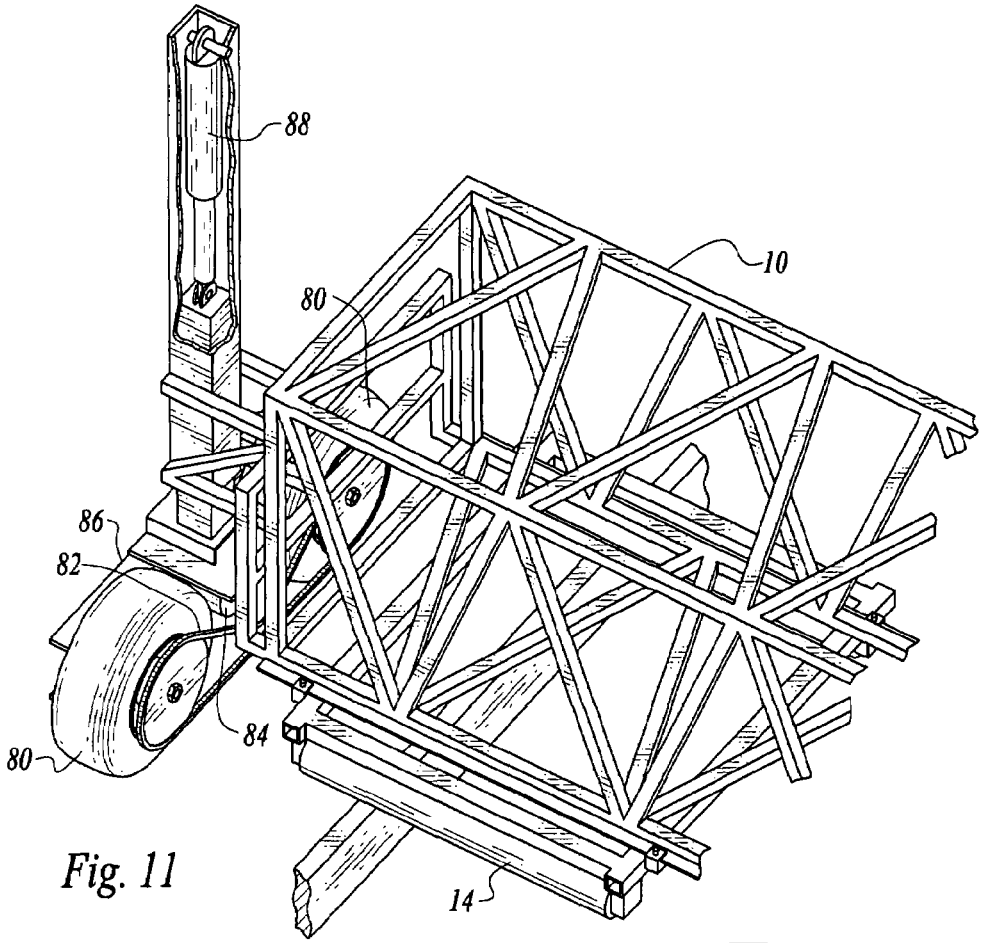
FIG. 11 is an enlarged, perspective view illustrating an end of the support of the alternative embodiment and showing operational details of the support transport structure and a hydraulic jack associated therewith.
Figure 12:
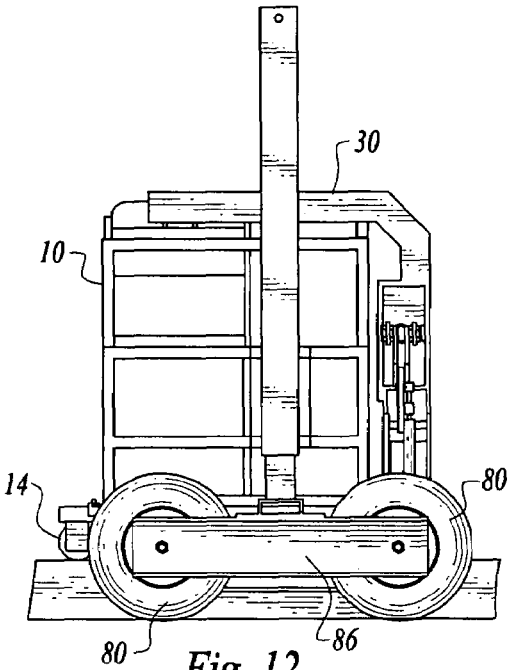
FIGS. 12 and 13 are end elevational views showing the support in lowered and raised positions respectively.
Figure 13:
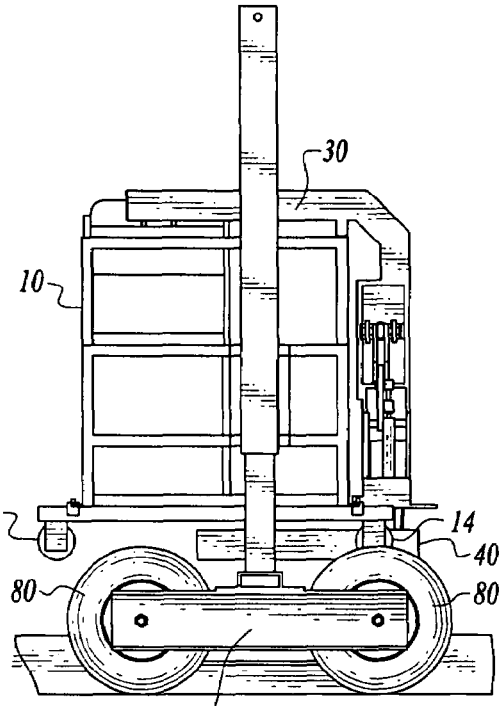

FIG. 10 is a schematic illustration of a jack 88 in association with a representative arrangement for controlling pressure to the jack. The arrangement includes a hydraulic pump 90 and pressure tank 92 connected to an up/down selector valve 94. A pressure reducing valve 96 is interposed between hydraulic lines 98, 100 leading to the jack cylinder and up/down selector valve 94. Operatively associated with the pressure reducing valve are a pressure setting control knob 102 and a pressure gauge 104.

The invention claimed is:

1. Screeding apparatus for engaging, moving and compacting wet concrete during formation of a concrete slab in a cavity defined by spaced side forms, said screeding apparatus comprising, in combination:

a double-ended, elongated support comprising a rigid framework extending completely across said cavity;

support transport structure for transporting said elongated support in a predetermined direction along said spaced side forms;

a carriage mounted on said elongated support for movement along said elongated support in a direction transverse to said predetermined direction;

a strike board depending from said carriage for engaging wet concrete in said cavity and mounted for movement up and down relative to said carriage;

carriage mover structure for moving said carriage and said strike board transverse to said predetermined direction along said elongated support to selectively position said carriage and said strike board in selected alternative positions over said space whereby said strike board is engageable with wet concrete of different width segments of said concrete slab between said spaced side forms; and strike board moving structure operatively associated with said carriage and with said strike board for selectively moving said strike board up or down relative to said carriage within said cavity during transport of said elongated support along said spaced side forms by said support transport structure for varying the distance said strike board enters said cavity.

2. The screeding apparatus according to claim 1 additionally comprising vibrator structure operatively connected to said strike board for vibrating said strike board.

3. The screeding apparatus according to claim 1 wherein said support transport structure includes rollers located at opposed ends of said elongated support supporting said elongated support on said spaced side forms.

4. The screeding apparatus according to claim 3 wherein said support transport structure additionally comprises drive winches located at opposed ends of said elongated support and cables extending along said side forms in operative engagement with said drive winches.

5. The screeding apparatus according to claim 2 wherein said vibrator structure includes a drive motor, a drive belt driven by said drive motor, a shaft rotatably mounted on said strike board driven by said belt, and one or more weights eccentrically mounted on said shaft.

6. The screeding apparatus according to claim 1 wherein said strike board moving structure includes mechanical linkage having at least one link member pivotally mounted on said carriage and a prime mover for selectively pivoting said at least one link member, said mechanical linkage being connected to said strike board and responsive to pivoting of said link member by said prime mover to selectively move said strike board either up or down.

7. The screeding apparatus according to claim 1 wherein said carriage mover structure includes at least one drive winch mounted on said carriage and a cable extending along said elongated support in operative engagement with said drive winch.

8. The screeding apparatus according to claim 1 additionally comprising an operator's station located at one end of said elongated support.

9. The screeding apparatus according to claim 1 wherein said support transport structure comprises ground engaging drive wheels disposed at opposed ends of said rigid framework and rollers spaced inwardly of said drive wheels connected to said framework and positioned on said spaced side forms, said drive wheels and said rollers simultaneously providing support for said rigid framework.

10. The screeding apparatus according to claim 9 wherein said support transport structure additionally comprises hydraulic jacks between said drive wheels and said framework to selectively move said framework toward or away from said drive wheels to vary the weight carried by said drive wheels and said rollers.

* * * * *